US005517732A

United States Patent [19]

Crear

[11] Patent Number: 5,517,732

[45] Date of Patent: May 21, 1996

[54] GASOLINE NOZZLE HANDLE HOLDER

[76] Inventor: Brent J. Crear, 621 Mammoth Rd., Dracut, Mass. 01826

[21] Appl. No.: 325,055

[22] Filed: Oct. 19, 1994

[51] Int. Cl.[6] ..... B65B 3/04

[52] U.S. Cl. ..... 24/299; D8/354; D8/349; 248/231.41; 251/111; 141/392

[58] Field of Search ..... 24/299, 521, 523; 248/231.4, 316.4, 407; 269/210, 215; 141/390, 391, 392; 251/111; D8/354; 74/526

[56] References Cited

U.S. PATENT DOCUMENTS

| | | | |
|---|---|---|---|
| 140,747 | 7/1873 | Walker | 269/215 |
| 540,555 | 6/1895 | Mader | 269/215 |
| 1,145,514 | 7/1915 | Schiek et al. | 269/210 X |
| 1,201,461 | 10/1916 | Hargrave | 269/215 |
| 4,200,128 | 4/1980 | Pokrzywa | D8/354 X |
| 4,210,181 | 7/1980 | Clevenger | D8/354 X |
| 4,690,182 | 9/1987 | Knaus | D8/354 X |
| 5,118,074 | 6/1992 | Weissman | D8/349 X |
| 5,163,206 | 11/1992 | Hernandez | 24/299 |

FOREIGN PATENT DOCUMENTS

| | | | |
|---|---|---|---|
| 615047 | 12/1948 | United Kingdom | 269/215 |

*Primary Examiner*—Peter M. Cuomo
*Assistant Examiner*—Robert J. Sandy

[57] ABSTRACT

A holder for maintaining the handle of a gasoline dispensing nozzle in a desired position. The inventive device includes a vertical stanchion having an upper clamp leg projecting therefrom. A lower clamp leg is adjustably coupled to the vertical stanchion and can be positioned at a desired distance from the upper clamp leg. The device can be utilized to capture the handle and a portion of the nozzle between the clamp legs to maintain the nozzle in an open position for fueling of an associated vehicle.

3 Claims, 4 Drawing Sheets

GASOLINE NOZZLE HANDLE HOLDER

BACKGROUND OF THE INVENTION

1. Field of the Invention

The present invention relates to holding devices and more particularly pertains to a gasoline nozzle handle holder for maintaining the handle of a gasoline dispensing nozzle in a desired position.

2. Description of the Prior Art

The use of holding devices is known in the prior art. More specifically, holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art holding devices include U.S. Pat. No. 4,811,765; U.S. Pat. Nos. Des. 316,029; 308,918; 299,112; and 297,612.

While these devices fulfill their respective, particular objectives and requirements, the aforementioned patents do not disclose a gasoline nozzle handle holder for maintaining the handle of a gasoline dispensing nozzle in a desired position which includes a vertical stanchion having an upper clamp leg projecting therefrom, and a lower clamp leg adjustably coupled to the vertical stanchion, whereby the handle and a portion of the nozzle can be captured between the clamp legs to maintain the nozzle in an open position for fueling of a vehicle.

In these respects, the gasoline nozzle handle holder according to the present invention substantially departs from the conventional concepts and designs of the prior art, and in so doing provides an apparatus primarily developed for the purpose of maintaining the handle of the gasoline dispensing nozzle in a desired position.

SUMMARY OF THE INVENTION

In view of the foregoing disadvantages inherent in the known types of holding devices now present in the prior art, the present invention provides a new gasoline nozzle handle holder construction wherein the same can be utilized for maintaining the handle of a gasoline dispensing nozzle in a desired position for fueling of an associated vehicle. As such, the general purpose of the present invention, which will be described subsequently in greater detail, is to provide a new gasoline nozzle handle holder apparatus and method which has many of the advantages of the holding devices mentioned heretofore and many novel features that result in a gasoline nozzle handle holder which is not anticipated, rendered obvious, suggested, or even implied by any of the prior art holding devices, either alone or in any combination thereof.

To attain this, the present invention generally comprises a holder for maintaining the handle of a gasoline dispensing nozzle in a desired position. The inventive device includes a vertical stanchion having an upper clamp leg projecting therefrom. A lower clamp leg is adjustably coupled to the vertical stanchion and can be positioned at a desired distance from the upper clamp leg. The device can be utilized to capture the handle and a portion of the nozzle between the clamp legs to maintain the nozzle in an open position for fueling of an associated vehicle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gasoline nozzle handle holder apparatus and method which has many of the advantages of the holding devices mentioned heretofore and many novel features that result in a gasoline nozzle handle holder which is not anticipated, rendered obvious, suggested, or even implied by any of the prior art holding devices, either alone or in any combination thereof.

It is another object of the present invention to provide a new gasoline nozzle handle holder which may be easily and efficiently manufactured and marketed.

it is a further object of the present invention to provide a new gasoline nozzle handle holder which is of a durable and reliable construction.

An even further object of the present invention is to provide a new gasoline nozzle handle holder which is susceptible of a low cost of manufacture with regard to both materials and labor, and which accordingly is then susceptible of low prices of sale to the consuming public, thereby making such gasoline nozzle handle holders economically available to the buying public.

Still yet another object of the present invention is to provide a new gasoline nozzle handle holder which provides in the apparatuses and methods of the prior art some of the advantages thereof, while simultaneously overcoming some of the disadvantages normally associated therewith.

Still another object of the present invention is to provide a new gasoline nozzle handle holder for maintaining the handle of a gasoline dispensing nozzle in an open position for fueling of an associated vehicle.

Yet another object of the present invention is to provide a new gasoline nozzle handle holder which includes a vertical stanchion having an upper clamp leg projecting therefrom, and a lower clamp leg adjustably coupled to the vertical stanchion, whereby the handle and a portion of the nozzle can be captured between the clamp legs to maintain the nozzle in an open position for fueling of a vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof, Such description makes reference to the annexed drawings wherein.

DESCRIPTION OF THE PREFERRED EMBODIMENT

Figure 1:
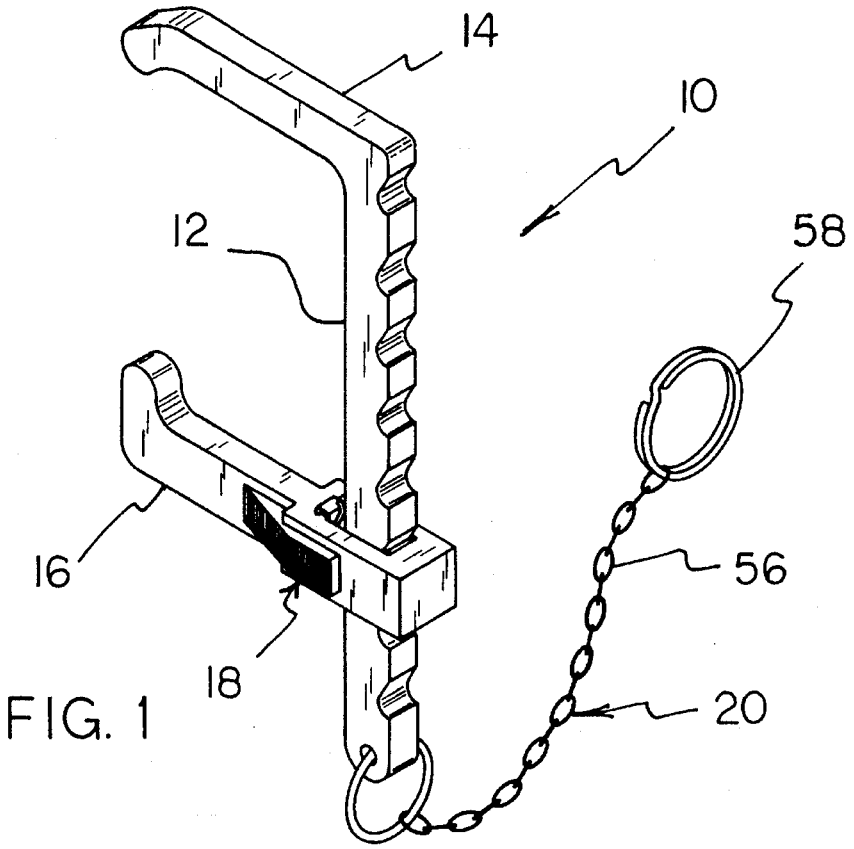
FIG. 1 is an isometric illustration of a gasoline nozzle handle holder according to the present invention.

With reference now to the drawings, and in particular to FIGS. 1–8 thereof, a new gasoline nozzle handle holder embodying the principles and concepts of the present invention and generally designated by the reference numeral 10 will be described.

More specifically, it will be noted that the gasoline nozzle handle holder 10 comprises an elongated vertical stanchion 12 having an upper end spaced from a lower end, with an upper clamp leg 14 projecting substantially orthogonally from the upper end thereof. A lower clamp leg 16 is adjustably coupled to the vertical stanchion 12 by an adjustment means 18 for permitting movement of the lower clamp leg 16 along the vertical stanchion 12. The adjustment means 18 is further operable to secure a position of the lower clamp leg 16 relative to the vertical stanchion 12 as desired. A key chain assembly 20 is coupled to the lower end of the vertical stanchion 12 and can be utilized to couple the device 10 to a plurality of keys or the like. The device 10 can be utilized to capture the actuating handle of a gasoline dispensing nozzle, as well as a portion of the dispensing nozzle, between the clamp legs 14, 16 to retain the nozzle in an open position during fueling of an associated vehicle.

Figure 2:
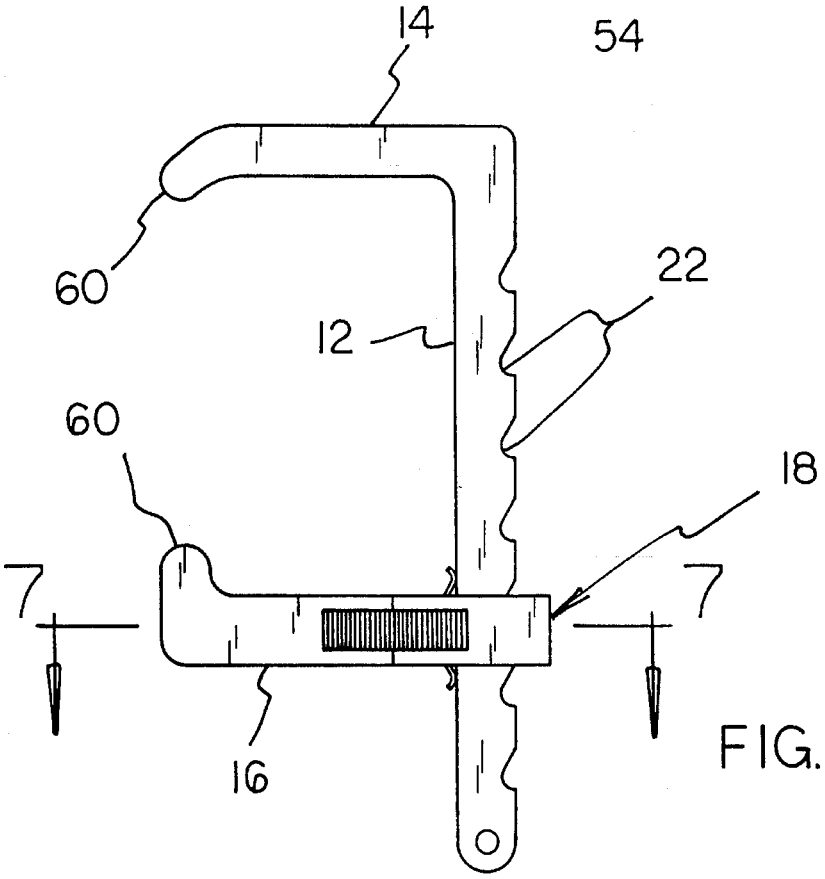
FIG. 2 is a side elevation view thereof.
Figure 3:
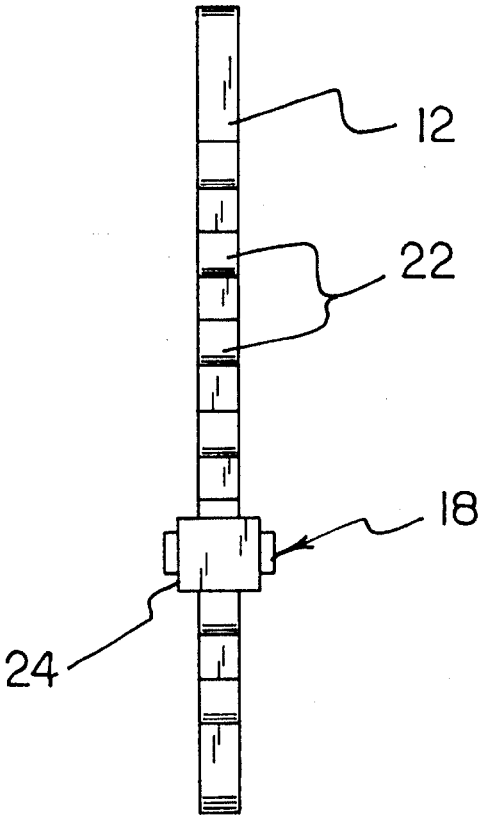
FIG. 3 is a rear elevation view of the invention.
Figure 4:
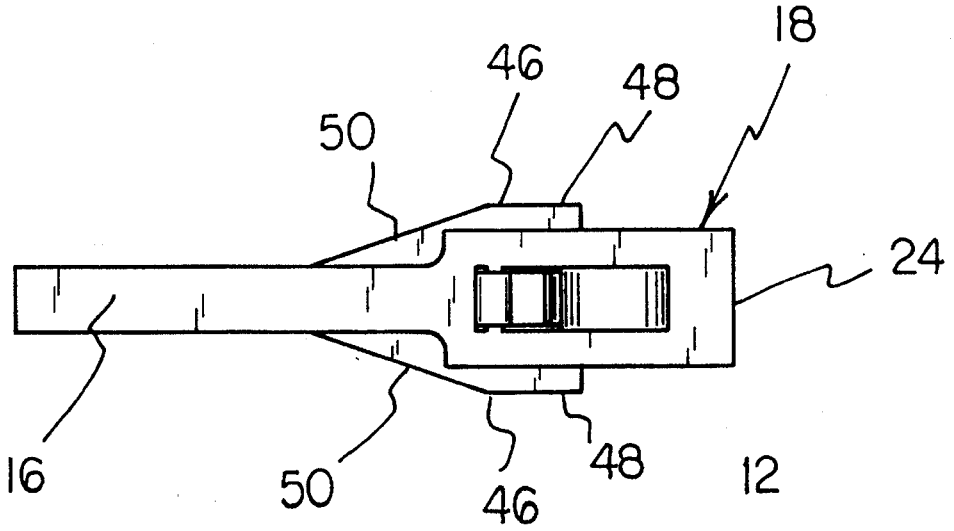
FIG. 4 is a bottom plan view thereof.
Figure 5:
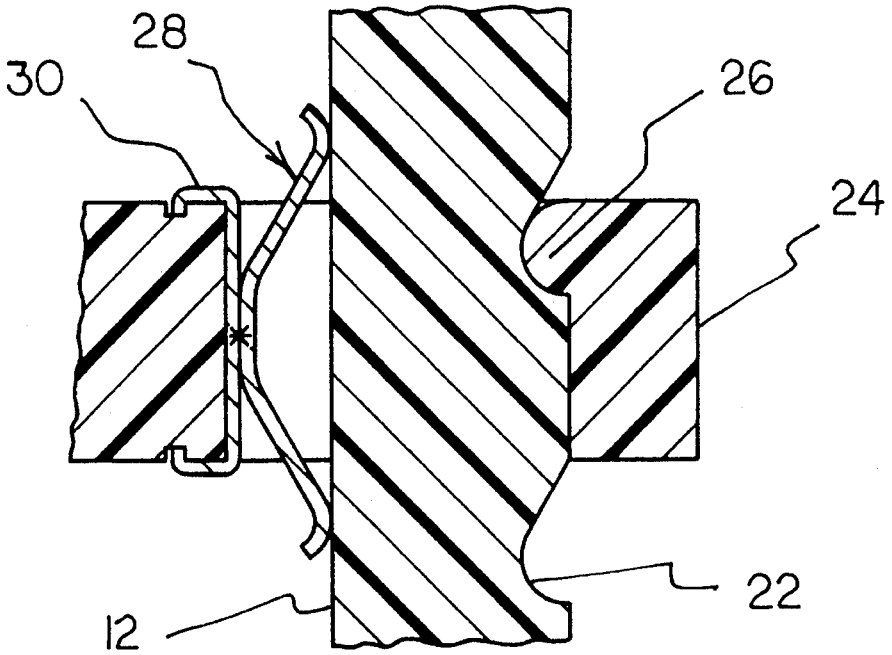
FIG. 5 is a cross sectional view of an adjustment means comprising a portion of the present invention in an engaged position.
Figure 6:
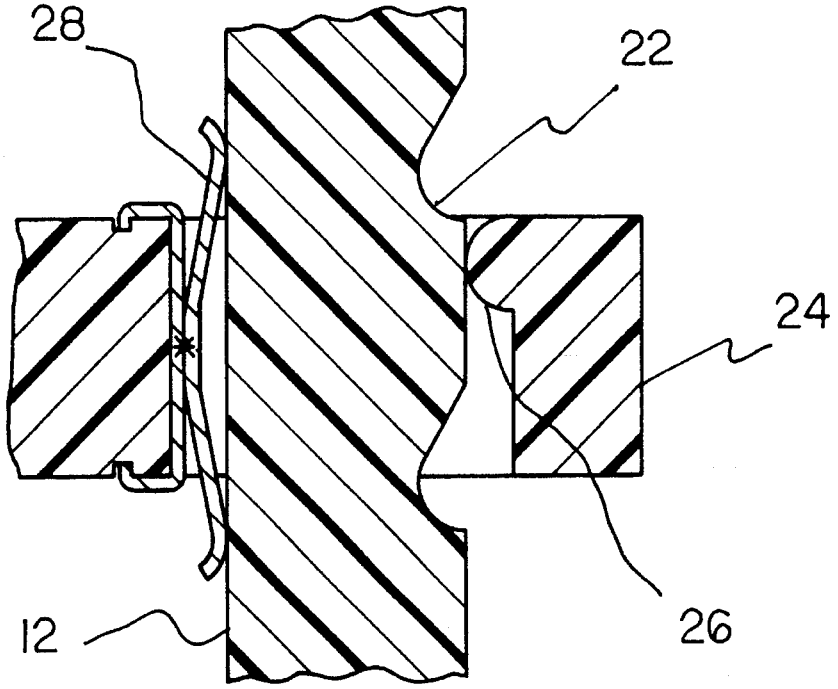
FIG. 6 is a further cross sectional view of the adjustment means in a disengaged position.

As best illustrated in FIGS. 2 and 3, the vertical stanchion 12 is provided with a plurality of spaced detent notches 22 which individually cooperate with the adjustment means 18 to position the lower clamp leg 16 at any one of a plurality of distances from the upper clamp leg 14. To this end, and as shown in FIGS. 3–6, the adjustment means 18 comprises a mounting block 24 having a through-extending aperture permitting projection of the vertical stanchion 12 therethrough. A lower clamp leg 16 is fixedly secured to the mounting block 24 and projects outwardly therefrom into a substantially parallel orientation with the upper clamp leg 14. As shown in FIG. 5, the mounting block 24 includes an arcuate projection 26 which extends inwardly from the through-extending aperture and is operable to engage any one of the detent notches 22. A retainer spring 28 is mounted within the aperture of the mounting block 24 on an opposed side thereof relative to the arcuate projection 26 and operates to bias the vertical stanchion 12 towards the arcuate projection 26 to encourage engagement of the arcuate projection into one of the detent notches 22. By this structure, the mounting block 24 and the associated lower clamp leg 16 are secured in a desired position through an engagement of the arcuate projection 26 with one of the detent notches 22, whereby a resilient deformation of the retainer spring 28 through a movement of the mounting block 24 in a transverse direction relative to the vertical stanchion 12 will release the arcuate projection 26 from a specific detent notch 22 as shown in FIG. 6, to permit a sliding movement of the mounting block 24 and the associated lower clamp leg 16 along the vertical stanchion 12 to position the arcuate projection into another one of the detent notches 22. Thus, the lower clamp leg 16 can be adjustably positioned into any one of the distances defined by the detent notches 22 from the upper clamp leg 14.

Figure 8:
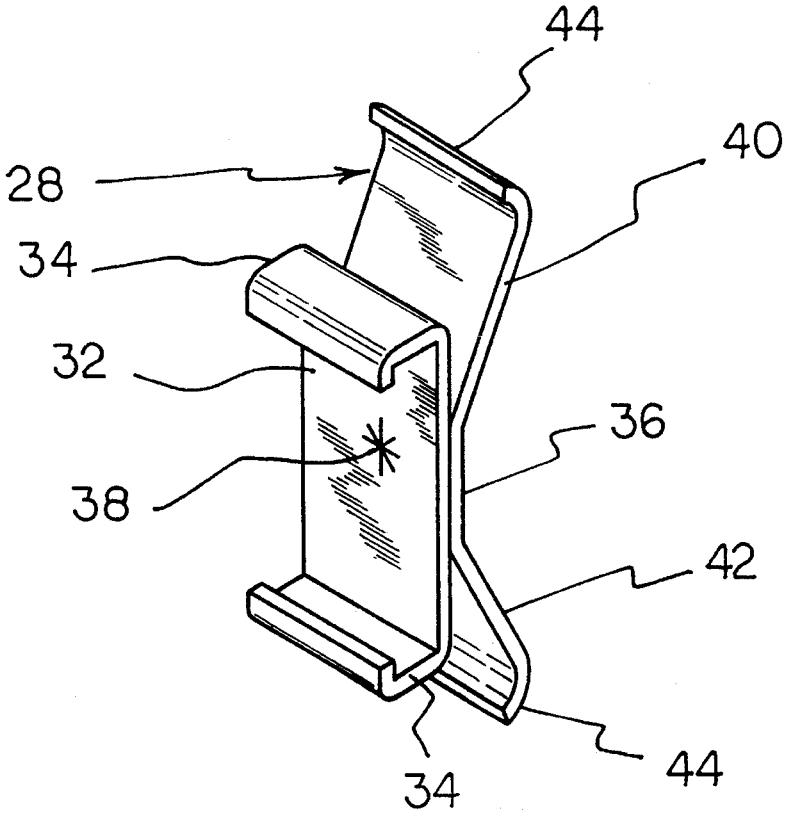
FIG. 8 is an isometric illustration of a retainer spring comprising a portion of the adjustment means.

As shown in FIG. 8, the retainer spring 28 comprises a spring mount 30 including a mounting plate 32 having a c-shaped ends 34 projecting from respectively opposed ends thereof which cooperate to engage and capture a portion of the mounting block 24. A spring base 36 is fixedly secured to the mounting plate 32 by a spot weld 38. A first spring leg 40 projects in a first direction from the spring base 36 and is oriented at an oblique angle relative thereto, with a second spring leg 42 projecting in a second direction from the spring base 36 and similarly oriented at an oblique angle relative thereto. The spring legs 40, 42 terminate in arcuate engaging ends 44 which operate to slidably engage the un-notched edge of the vertical stanchion 12 to permit sliding movement of the retainer spring 28 thereover.

Figure 7:
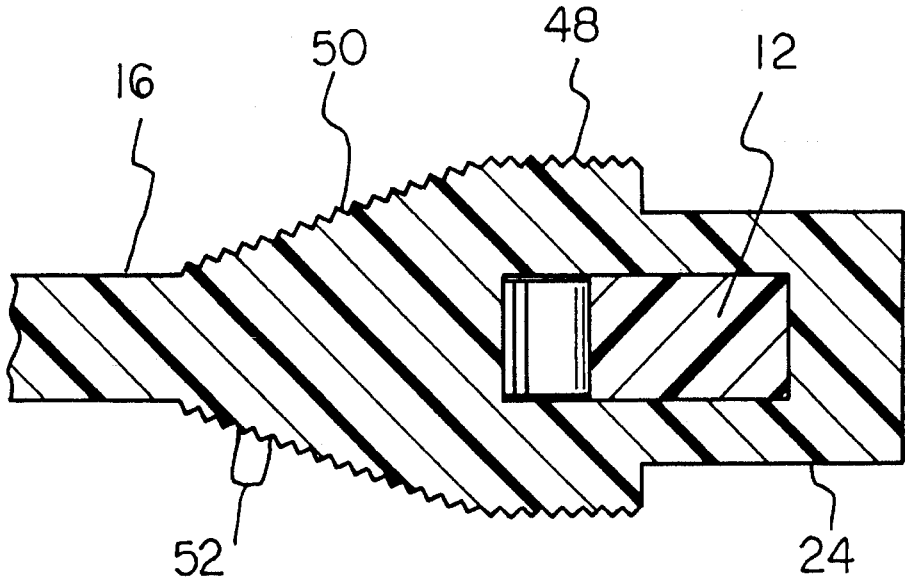
FIG. 7 is a cross sectional view taken along line 7—7 of FIG. 2.

To facilitate a manual compression of the retainer spring 28 though a transverse movement of the mounting block 24 relative to the vertical stanchion 12, a pair of gripping members 46 are secured to respectively opposed sides of the mounting block 24. The gripping members 46 each comprise a straight portion 48 extending along a portion of the mounting block 24, and an angled portion 50 extending from the lower clamp leg 16 to integrally connect with the straight portion 48. As shown in FIG. 7, the portions 48, 50 of the gripping members 46 include a plurality of serrations 52 which promote frictional engagement between the gripping members 46 and an individual's fingers during manipulation of the device 10.

As shown in FIG. 1, the key chain assembly 20 permitting coupling of the vertical stanchion 12 through a plurality of keys comprises a closed ring 54 extending through the lower end of the vertical stanchion 12, with a length of chain 56 extending therefrom. A split ring 58 is coupled to a distal end of the length of chain 56 and is operable to mechanically engage and retain a plurality of keys thereon. By this structure, the gasoline nozzle handle holder 10 can be utilized to tether and retain a plurality of keys to preclude a loss of such keys.

In use, the gasoline nozzle handle holder 10 according to the present invention can be adjusted to position the lower clamp leg 16 a desired position distance from the upper clamp leg 14, whereby the device 10 can then be positioned onto a gasoline dispensing nozzle so as to capture the actuating handle and a portion of the dispensing nozzle between the clamp legs 14, 16 to retain the actuating handle in an operating position, whereby the fueling an associated vehicle can be accomplished. Preferably, the clamp legs 14, 16 each include an extending projection 16 extending from a distal end thereof which serves to preclude unintentional removal of the device 10 from the associated gas dispensing nozzle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gasoline nozzle handle holder comprising;

an elongated vertical stanchion having a plurality of spaced detent notches thereon, and having an upper end spaced from a lower end;

an upper clamp leg projecting from said upper end of said vertical stanchion;

a lower clamp leg; and, an adjustment means comprising a mounting block having a through-extending aperture with said vertical stanchion projecting therethrough, said lower clamp leg being fixedly secured to said mounting block so as to project outwardly therefrom into a substantially parallel orientation with said upper clamp leg, said mounting block including an arcuate projection which extends inwardly from said through-extending aperture to engage an individual one of said detent notches; and a retainer spring mounted within said aperture of said mounting block to bias said vertical stanchion towards said arcuate projection to promote engagement of said arcuate projection into an individual one of said detent notches, said retainer spring comprising a spring mount including a mounting plate having c-shaped ends projecting from respectively opposed ends thereof which cooperate to engage and capture a portion of said mounting block; a spring base fixedly secured to said mounting plate; a first spring leg projecting in a first direction from said spring base and oriented at an oblique angle relative thereto; and a second spring leg projecting in a second direction from said spring base and oriented at an oblique angle relative thereto, said spring legs terminating in arcuate engaging ends which slidably engage an un-notched edge of said vertical stanchion to permit sliding movement of said retainer spring thereover.

2. The gasoline nozzle handle holder of claim 1, and further comprising a pair of gripping members secured to respectively opposed sides of said mounting block, said gripping members each comprising a straight portion extending along a portion of said mounting block, and an angled portion extending from said lower clamp leg to integrally connect with said straight portion, said portions of said gripping members including a plurality of serrations which promote frictional engagement between said gripping members and an individual's fingers.

3. The gasoline nozzle handle holder of claim 2, and further comprising a key chain assembly coupled to a lower end of said vertical stanchion for coupling the holder to a plurality of keys.

* * * * *